US005530417A

United States Patent [19]

Hohider

[11] Patent Number: 5,530,417

[45] Date of Patent: Jun. 25, 1996

[54] THERMAL CUTOFF WITH FLOATING CONTACT MEMBER

[75] Inventor: David A. Hohider, Wooster, Ohio

[73] Assignee: Therm-O-Disc, Incorporated, Mansfield, Ohio

[21] Appl. No.: 254,509

[22] Filed: Jun. 6, 1994

[51] Int. Cl.[6] ..... H01H 37/76; H01H 37/64; H01H 1/14

[52] U.S. Cl. ..... 337/408; 337/413; 200/239

[58] Field of Search ..... 337/401, 402, 337/407, 408, 409, 413, 317; 200/239

[56] References Cited

U.S. PATENT DOCUMENTS

| | | | |
|---|---|---|---|
| Re. 29,391 | 9/1977 | Kawiecki | 337/28 |
| 3,274,361 | 9/1966 | Ebensteiner | 200/123 |
| 3,291,945 | 12/1966 | Merrill . | |
| 3,462,572 | 8/1969 | Sofianek | 200/144 |
| 3,519,972 | 7/1970 | Merrill | 337/407 |
| 4,152,564 | 5/1979 | Wirz | 200/239 |
| 4,246,564 | 1/1981 | Olson | 331/409 |
| 4,514,718 | 4/1985 | Birx | 337/407 |
| 4,707,044 | 11/1987 | Burns | 439/289 |

*Primary Examiner*—Leo P. Picard
*Assistant Examiner*—Stephen T. Ryan
*Attorney, Agent, or Firm*—Jones, Day, Reavis & Pogue

[57] ABSTRACT

A thermal cutoff having a mushroom-shaped floating contact member with an enlarged head and an elongated shank. The outwardly facing end of the enlarged head has a centrally located depression for reducing the area of the head end surface that engages a sliding contact for the purpose of increasing contact pressure and thereby reducing electrical resistance. The shank has a necked-in terminal end portion to facilitate assembly by minimizing the possibility that the shank end will hang up on a bushing that receives the shank. The head is enlarged sufficiently to accept a straight coil spring as well as a tapered coil spring.

12 Claims, 3 Drawing Sheets

THERMAL CUTOFF WITH FLOATING CONTACT MEMBER

BACKGROUND OF THE INVENTION

This application relates to the art of electrical contact members and, more particularly, to electrical contact members used in electrical fuses. The invention is particularly applicable for use in thermal cutoffs and will be described with specific reference thereto. However, it will be appreciated that the invention has broader aspects and can be used in other environments.

A known type of thermal cutoff includes a generally mushroom-shaped floating contact member having an enlarged head and an elongated shank. The outer end of the enlarged head is flat and engages a sliding contact. Due to the large area of the outer end surface of the head, the unit engagement pressure between such surface and the sliding contact is relatively low. In some instances, the unit engagement pressure is so low that the electrical resistance is unacceptably high. It would be desirable to increase the unit pressure between a sliding contact and a floating contact member of the type described in order to maintain the resistance thereacross at acceptable levels. In thermal cutoffs of the type described, the elongated shank on the floating contact member has a sharp edge adjacent its outer end. During assembly of the thermal cutoff, the floating contact member may be cocked or tilted when a bushing is inserted for reception over the shank and the bushing may hang up on the sharp edge. It would be desirable to shape the terminal end portion of the shank to minimize the possibility of such hang-ups.

SUMMARY OF THE INVENTION

A thermal cutoff of the type described has a central depression of the outer surface of the enlarged head. This significantly reduces the surface area of the outer end of the enlarged head and increases the unit pressure between the remaining outer surface and a sliding contact engaged thereby.

In a preferred arrangement, the depression in the outer end of the enlarged head is substantially conical and occupies more than one-half of the outer end area of the enlarged head. The conical depression preferably slopes inwardly at an angle not greater than about 15°. Also, the depression preferably has a maximum depth not greater than about 0.010 inch in order to prevent undesirable weakening of the enlarged head.

The elongated shank is necked-in adjacent its terminal end opposite from the enlarged head. The necked-in portion is preferably smoothly curved or otherwise tapered for eliminating sharp edges in undesirable locations to minimize the possibility of hang-ups on a ceramic bushing that is assembled over the shank.

It is a principal object of the present invention to provide an improved floating contact member for use in thermal cutoffs.

It is an additional object of the invention to provide such a contact with an enlarged head having an outer end that is shaped for enhancing unit pressure between such end and a sliding contact.

It is another object of the invention to provide such a floating contact member with an elongated shank that is shaped adjacent its terminal end for minimizing the possibility of hang-ups with a ceramic bushing assembled over the shank.

It is an additional object of the invention to provide an improved thermal cutoff having an improved floating contact member incorporated therein.

DESCRIPTION OF PREFERRED EMBODIMENTS

Figure 1:
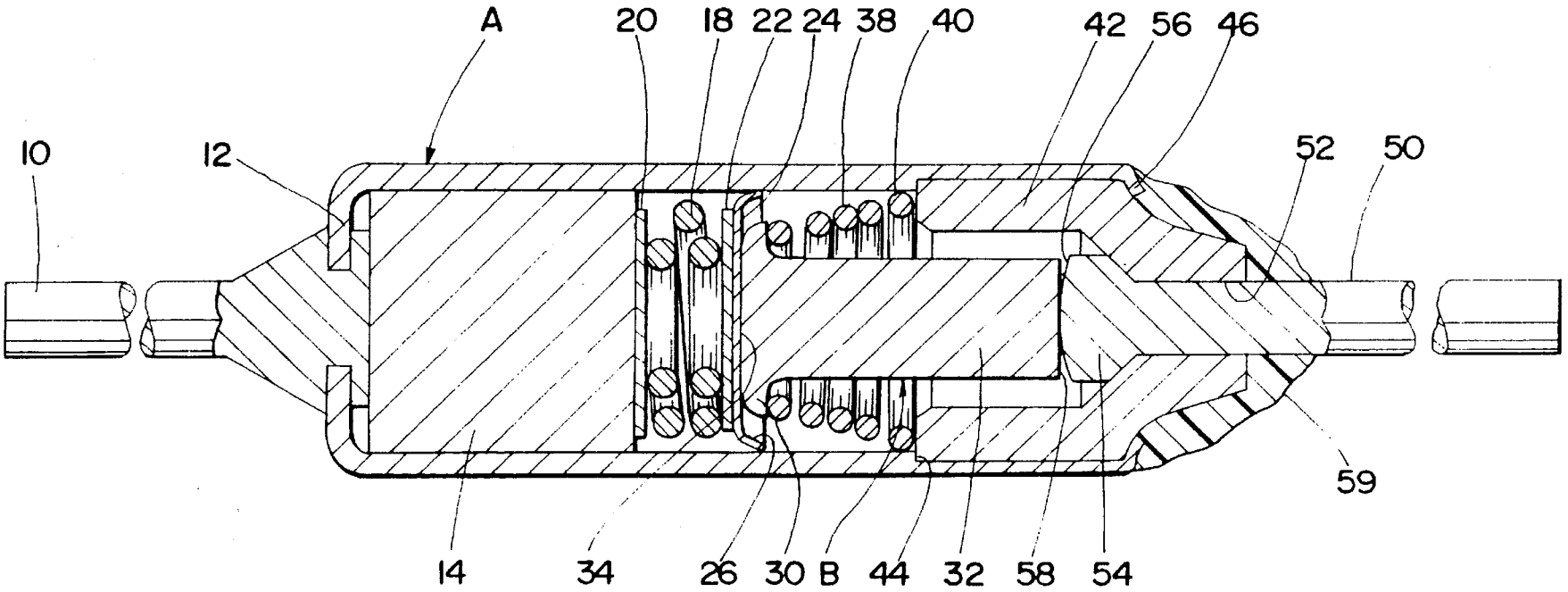
Fig. 1 (PRIOR ART)
FIG. 1 is a cross-sectional elevational view of a prior art thermal cutoff having a floating contact member therein.

Referring now to the drawing, wherein the showings are for purposes of illustrating certain preferred embodiments of the invention only and not for purposes of limiting same, FIG. 1 shows a prior art thermal cutoff including a tubular metal housing A having a related lead 10 attached to an end wall 12 thereof. A normally solid dielectric thermal pellet 14 is positioned within housing A adjacent end wall 12. Thermal pellet 14 may be of many different materials including caffeine or animal protein and liquifies at a predetermined temperature.

A compression spring 18 is compressed between discs 20, 22 that respectively engage thermal pellet 14 and a sliding metal electrical contact 24. Contact 24 has a plurality of circumferentially-spaced resilient fingers 26 resiliently engaging the interior of metal housing A.

A generally mushroom-shaped floating contact member B includes an enlarged head 30 and an elongated shank 32. Enlarged head 30 has a flat outer end surface 34 engaging slidable contact 24. The size of enlarged head 30 is minimized for reducing the area of end surface 34 to increase the unit pressure between such surface and sliding contact 24. Minimizing the size of enlarged head 30 requires the use of a tapered coil trip spring 38 that surrounds shank 32 and engages the rear surface of enlarged head 30. The other end of trip spring 38 engages end 40 on a ceramic bushing 42 received in the open end of housing A. Bushing 42 engages an internal shoulder 44 in housing A and the terminal end portion of housing A is crimped inwardly at 46 for securing bushing 42 within housing A.

An isolated lead 50 extends through a hole 52 in bushing 42 and has an enlarged contact head 54 thereon with a convex contact end surface 56 that cooperates with terminal end 58 of shank 32. A sealing compound such as epoxy 59 covers the outer end surface of bushing 42 and housing crimp 46, and surrounds a portion of isolated lead 50 to seal the central hole through the bushing.

The thermal cutoff is assembled by inserting components one at a time into housing A starting with thermal pellet 14. When floating contact member B and trip spring 38 are positioned within housing A, floating contact member 32 may be off center or may be tilted with shank 32 engaging the inner surface of housing A. Under such circumstances, it is difficult to then insert bushing 42 and its related isolated lead 50 into housing A because the end of bushing 42 will hang up on the end or edge of shank 32.

The internal components of the thermal cutoff are normally located as shown in FIG. 1. When the predetermined trip temperature is reached, thermal pellet 14 liquifies allowing compression spring 18 to expand toward housing end wall 12 while carrying disc 20 therewith. The biasing force of trip spring 38 then exceeds the biasing force of now expanded compression spring 18 so that floating contact member 32 and sliding contact 24 are also biased toward housing end wall 12 away from isolated contact 50. Separation of isolated lead contact surface 56 and shank contact surface 58 interrupts the electrical circuit between related and isolated leads 10, 50.

Figure 2:
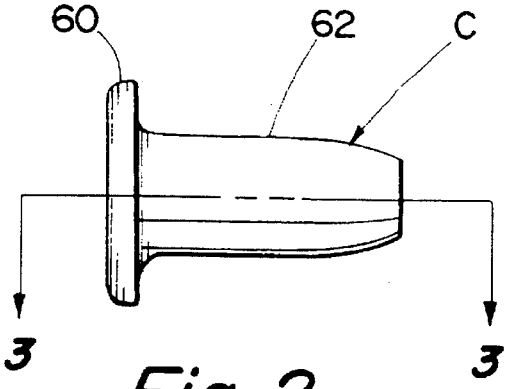
FIG. 2 is a side elevational view of an improved floating contact member constructed in accordance with the present application.
Figure 3:
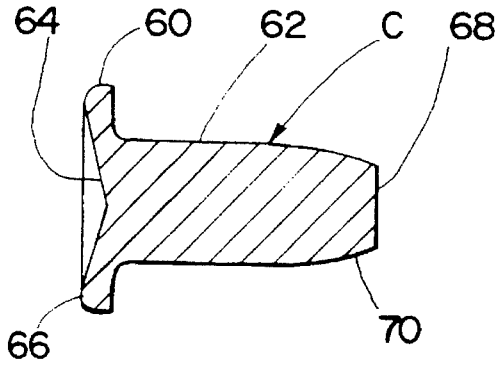
FIG. 3 is a cross-sectional elevational view taken on line 3—3 of FIG. 2.
Figure 4:
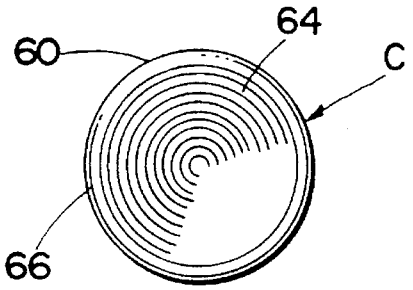
FIG. 4 is an end view of the enlarged head on the floating contact member of FIGS. 2 and 3.

Referring now to FIGS. 2, 3 and 4, an improved generally mushroomed-shaped floating contact member C in accordance with the present application includes an enlarged head 60 and an elongated shank 62. Examples of dimensions will be given by example only and not by way of limitation simply to compare the previous floating contact member with the improved floating contact member. Elongated cylindrical shank 62 has a nominal diameter of about 0.060 inches which is the same as the diameter of the prior floating contact member. Circular enlarged head 60 has a nominal diameter of about 0.115 inches compared to a nominal diameter of about 0.105 inches for enlarged head 30 on the prior art floating contact member. Enlarged head 60 has a diameter that is about two times the diameter of shank 62. This means that it is within plus or minus 0.01 inch of two times the diameter of shank 62 (0.110–0.130).

A substantially centrally located conical depression 64 is formed in the outer end of enlarged head 60. Depression 64 preferably occupies at least one-half of the area of the outer end of enlarged head 60. This provides an outwardly facing head contact surface 66 that is annular or ring-shaped and located adjacent the outer periphery of enlarged head 60 as shown in FIG. 4.

Obviously, depression 64 may take other shapes. The depth of the depression is preferably minimized in order to maintain the strength of enlarged head 60. The depth of depression 64 shown in FIG. 3 is about 0.006 inches and is preferably not greater than about 0.010 inches.

The terminal end portion of shank 62 adjacent flat shank outer end 68 is necked-in as generally indicated at 70. The necked-in portion is preferably smoothly curved instead of being tapered along a straight line. The extent of necking-in may vary and in the arrangement shown the diameter of flat end 68 is 0.040 inches.

Figure 5:
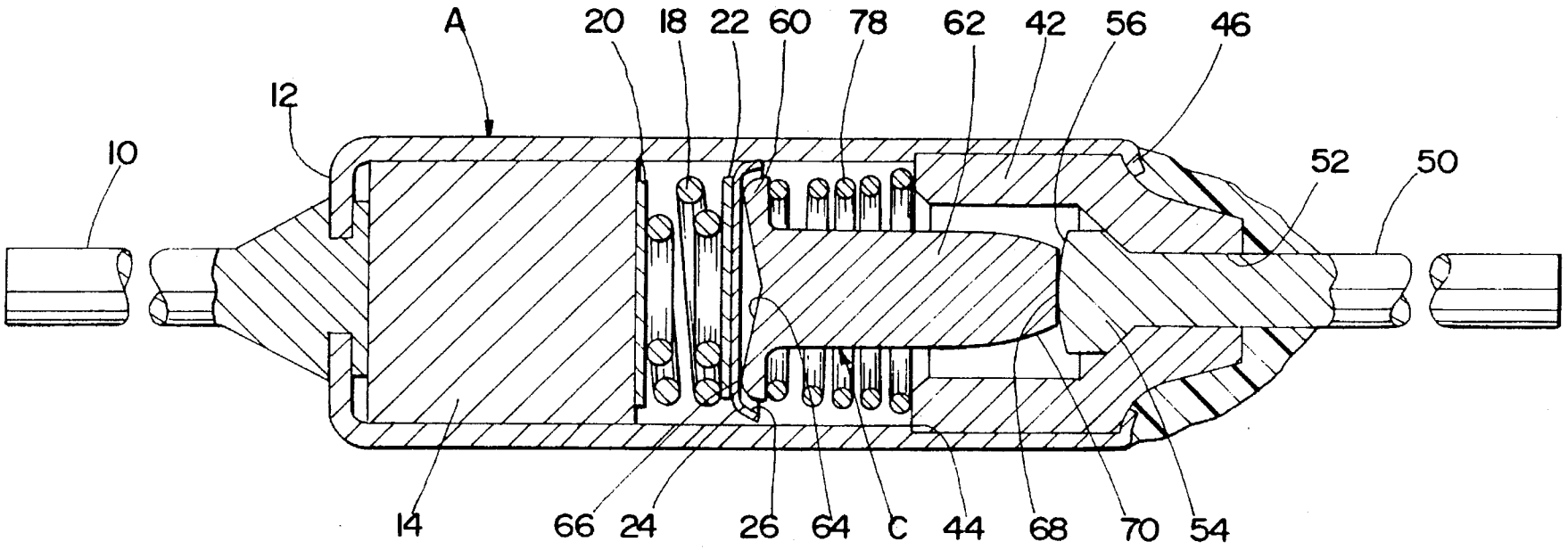
FIG. 5 is a cross-sectional elevational view of a thermal cutoff having the improved floating contact member of the present application incorporated therein.

FIG. 5 shows the improved floating contact member of the present invention assembled within a thermal cutoff. The larger diameter of enlarged head 60 makes it possible to use a straight trip spring 78 instead of the tapered spring 38 of FIG. 1. Although it is still possible to use a tapered spring in the arrangement of FIG. 5, assembly is simplified by having a straight spring with a larger opening for receiving shank 62 on floating contact member 64. The reduced end surface area 66 on enlarged head 60 provides a substantially higher unit pressure between floating contact member C and sliding contact 24 to minimize resistance.

The necked-in terminal end portion 70 on shank 62 facilitates reception of shank 62 within bushing 42. Even if floating member C is off center or is tilted, the necked-in sloping outer surface of shank 62 provides self-centering action to facilitate positioning of bushing 42 within housing A.

Figure 6:
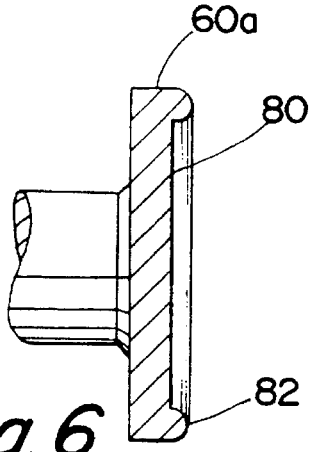
FIG. 6 is a partial cross-sectional elevational view showing an alternative shape for the enlarged head on the floating contact member.

FIGS. 6–9 show alternative embodiments. In FIG. 6, an enlarged head **60*a* has a substantially cylindrical depression 80 therein to leave a small annular projection 82** that provides the outer contact surface on the floating contact member.

Figure 7:
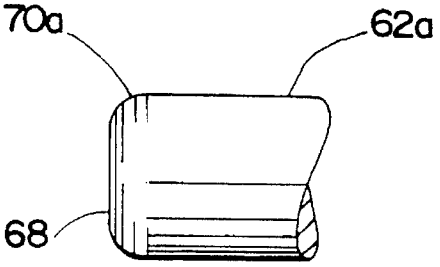
FIG. 7 is a partial elevational view of the terminal end portion of a shank on a floating contact member.

FIG. 7 shows an alternative shank **62*a* having a rounded end portion 70*a* instead of a sharp corner as in the prior art arrangement of FIG. 1**.

Figure 8:
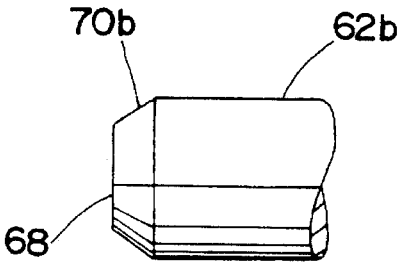
FIG. 8 is a view similar to FIG. 6 and showing another embodiment.

FIG. 8 shows shank **62*b* as having a tapered terminal end portion 70*b* intersecting outer terminal end 68**.

Figure 9:
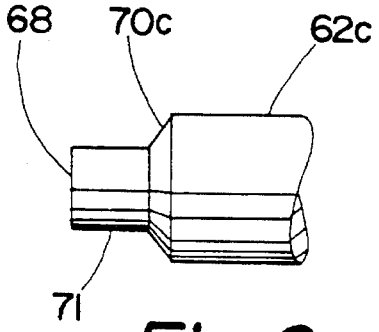
FIG. 9 is a view similar to FIGS. 6 and 7 and showing another embodiment.

FIG. 9 shows shank **62*c* having a tapered portion 70*c* intersecting a small diameter cylindrical portion 71 that extends to terminal end 68**.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. In a thermal cutoff having opposite isolated and related leads and a sliding contact intermediate said leads, a one-piece floating contact member normally engaging said isolated lead and said sliding contact and being movable with said sliding contact away from said isolated lead to interrupt an electrical connection between said leads, said floating contact being generally mushroom-shaped and including an elongated shank and an integral enlarged head, said head having an outwardly facing head end that includes a head contact surface engaging said sliding contact and remaining in engagement with said sliding contact when said floating contact member and said sliding contact move in unison away from said isolated lead, and said head end having a centrally located depression therein so that the area of said head contact surface is substantially smaller than the total area of said head end.

2. The thermal cutoff of claim 1 wherein said depression occupies more than one-half the area of said outwardly facing head end.

3. The thermal cutoff of claim 2 wherein said depression is substantially conical.

4. The thermal cutoff of claim 3 wherein said conical depression slopes inwardly at an angle not greater than about 15°.

5. The thermal cutoff of claim 1 wherein said depression has a maximum depth not greater than about 0.010 inch.

6. The thermal cutoff of claim 1 wherein said shank is substantially cylindrical and includes an outwardly facing shank end contact surface, said shank having a reduced cross-sectional size adjacent said shank end contact surface, and said reduced cross-sectional size being a substantially greater size reduction than obtainable by simply rounding off an intersecting edge between said shank and said shank end contact surface.

7. The thermal cutoff of claim 6 wherein said shank has an inwardly tapered surface adjacent said shank end contact surface.

8. The thermal cutoff of claim 7 wherein said tapered surface is arcuately curved inwardly.

9. The thermal cutoff of claim 1 wherein said shank is substantially cylindrical and said enlarged head is substantially circular, and said head having a diameter that is at least about two times the diameter of said shank.

10. The thermal cutoff of claim 1 wherein said shank is substantially cylindrical and has a shank diameter, said shank having an outwardly facing shank end contact surface that normally engages said isolated lead and separates from said isolated lead when said floating contact member moves away from said isolated lead, and said shank being reduced in size adjacent said shank end contact surface for reducing the area of said shank end contact surface such that the area of said shank end contact surface is at least about one-third smaller than the cross-sectional area of said shank across said predetermined diameter thereof.

11. A thermal cutoff having a one-piece generally mushroom-shaped floating contact member with an elongated shank and an integral enlarged head, said head having an outwardly facing head end with a reduced head end surface whose area is substantially smaller than the total area of said outwardly facing head end, said shank having an outwardly facing shank end contact surface, said thermal cutoff having a fixed contact engaging said shank end contact surface and a movable contact engaging said head end surface, said floating contact member and said movable contact being movable in unison for separating said shank end contact surface from said fixed contact to interrupt an electrically conductive path through said thermal cutoff, and said movable contact and said head end surface not being separable for interrupting the electrically conductive path through said thermal cutoff.

12. The thermal cutoff of claim 11 wherein said shank is cylindrical and said head is circular and has a diameter that is at least about two times the diameter of said shank, and said shank being reduced in size adjacent said shank end contact surface to provide said shank end contact surface with an area that is at least about one-third smaller than the cross-sectional area of said shank along the cylindrical length thereof.

* * * * *